US006941596B2

(12) United States Patent
Schuman et al.

(10) Patent No.: US 6,941,596 B2
(45) Date of Patent: Sep. 13, 2005

(54) BED FRAME

(76) Inventors: Ethan Joel Schuman, 8258 Groby Rd., University City, MO (US) 63138; William Vernon Koeneker, 12852 Vista Ridge, St. Louis, MO (US) 63138

( * ) Notice: Subject to any disclaimer, the term of this patent is extended or adjusted under 35 U.S.C. 154(b) by 0 days.

(21) Appl. No.: 10/394,532

(22) Filed: Mar. 21, 2003

(65) Prior Publication Data

US 2004/0181874 A1 Sep. 23, 2004

(51) Int. Cl.[7] ..... A47C 19/00
(52) U.S. Cl. ..... 5/286; 5/201; 5/200.1
(58) Field of Search ..... 5/286, 310, 200.1, 5/201

(56) References Cited

U.S. PATENT DOCUMENTS

| | | | | | |
|---|---|---|---|---|---|
| 475,980 | A | * | 5/1892 | Holt | 108/156 |
| 2,567,619 | A | * | 9/1951 | Rosenfeld | 5/181 |
| 2,721,338 | A | * | 10/1955 | Resnick | 5/285 |
| 2,871,489 | A | * | 2/1959 | Emmert | 5/114 |
| 4,224,704 | A | * | 9/1980 | Nowell | 5/181 |
| 4,729,136 | A | * | 3/1988 | Santo | 5/201 |
| 6,170,217 | B1 | | 1/2001 | Meyer | 52/693 |
| 6,397,412 | B1 | * | 6/2002 | Quintile | 5/200.1 |
| 6,463,651 | B1 | | 10/2002 | Koeneker et al. | 29/513 |
| 6,585,571 | B2 | | 7/2003 | Hyatt et al. | 451/61 |
| 6,611,977 | B1 | * | 9/2003 | Schuman et al. | 5/200.1 |

* cited by examiner

*Primary Examiner*—Sunil Singh
(74) *Attorney, Agent, or Firm*—Haverstock, Garrett & Roberts LLP

(57) ABSTRACT

A bed frame assembly for supporting a bed in a substantially flat manner above a floor including interlocking elongate rails and feet for forming a rectangular, flat platform, each of the feet including an upper portion defining a receptacle oriented in a first direction for receiving a longitudinal end a portion of a first of the rails, and a second receptacle oriented in a second direction at about a 90 degree angle to the first direction for receiving a portion of a second of the rails, such that when received in the receptacles, respectively, the first and second rails being in abutting interlocking relation and extend in the first and second directions defining the platform, and elements cooperatively engageable with each of the feet, respectively, for holding the rails in the abutting relation.

33 Claims, 9 Drawing Sheets

BED FRAME

TECHNICAL FIELD

This invention relates generally to bed frames for supporting box spring and mattress sets, and more particularly, to a bed frame preferably including roll-form metal rails which provide suitable torsional strength for anticipated loading conditions, and a plurality of interchangeable feet for supporting and connecting the bed rails, all which can be provided in a compact, lightweight kit for economical storage and transport, and which can be easily assembled into a strong, rigid structure.

BACKGROUND ART

Bed frames for supporting box springs and mattresses are well known. One popular type of such bed frames utilizes opposing L shape solid steel side rails foldably connected to L shape steel cross rail sections, the cross rail sections associated with the respective side rails being connectable together to form the bed frame. The side rails typically include downwardly extending feet or legs riveted or otherwise attached and on which the bed frame is supported. Each connected side and cross rail is foldable so as to be compacted for storage and shipping, and is unfolded and assembled with the other side and cross rail to form the bed frame.

One shortcoming found with the above discussed known bed frames is a relatively heavy weight, due primarily to the weight of the steel angle from which the rails are made, which is required for the anticipated loading, particularly, torsional loading, of the bed frame. This high weight is a disadvantage as it results in higher than desired shipping costs. Another shortcoming is that manufacture of the bed frames is relatively labor intensive and costly, due in at least large part to the requirement of cutting, drilling, and connecting together the parts thereof. The size of the bed frames when folded for shipping and storage is also larger than desired.

Thus, what is sought is an alternative bed rail and frame construction which overcomes many of the shortcomings set forth above, and which is strong, sturdy, and easily assembled.

DISCLOSURE OF THE INVENTION

What is disclosed is a roll-form bed rail, and a bed frame, including feet for supporting the frame, which overcome many of the shortcomings and problems set forth above. In a preferred embodiment of the roll-form bed rail, elongate sheet metal elements having a generally A shape profile when viewed from a longitudinal end thereof are provided, including an outer sheet metal layer which forms angularly related outer legs of the A shape profile defining a space therebetween, the outer legs being connected together at proximal ends thereof and having opposed distal ends. The elongate sheet metal elements additionally include an inner sheet metal layer disposed in the space between the outer legs and including a center brace portion which spans the space at a location intermediate the proximal and distal ends of the outer legs forming a triangular enclosed space between the proximal ends of the outer layer and the brace for bracing the legs against twisting or torsion and maintaining the space between them, the inner sheet metal layer including a pair of inner leg portions extending from the brace portion to the distal ends of the outer legs in overlaying surface-to-surface contact with the outer legs, respectively, and each of the inner leg portions including a distal end portion locked together with the distal end of the outer leg along the length of the rail, forming a stiffening beam for resisting bending of the rail. As another preferred aspect, the bed rail includes elements for rigidly connecting the outer legs and the inner leg portions together at at least spaced intervals along the length of the rail for maintaining rigid overlaying contact between the inner and outer layers of the rail. Such elements can include, for instance, connections made by commercially available apparatus under the trade name Tog-L-Loc which comprise cup shape receptacles on one of the sheet metal layers which lockingly receive correspondingly shaped portions on the other of the layers. As an example of the beam shape formed by the locked together distal ends and distal end portions, they can include overlaying U shape portions defining channels extending the length of the rail, to impart the desired stiffness and strength to the rails. As a result, the present roll-form bed rail has adequate strength to resist bending and torsional loading conditions anticipated to be encountered during use in a bed frame.

A preferred bed frame includes a plurality of rails, either of the new A shape profile as described above, or of known L cross sectional shapes or other similar suitable shapes, and a plurality of feet for connecting the rails together to form a rectangular and at least substantially planar support platform for holding a box spring and mattress in a substantially horizontal manner, with sufficient strength so as not to sag or collapse under anticipated loading conditions, including dynamic conditions such as when children or adults jump on the bed. Each foot includes opposite lower and upper portions, and is adapted to be positioned in an upstanding orientation on the lower portion thereof at any of several positions around the bed frame for connecting the rails together to form the rectangular platform. The upper portion of each foot includes an element defining at least one receptacle or slot therein oriented in a first predetermined horizontal direction and adapted for receiving a longitudinal end of one of the legs of a first of the rails, and another receptacle or slot oriented in a second predetermined horizontal direction and adapted for receiving a second of the rails, such that the first rail extends in the first horizontal direction, and the second rail extends in the second horizontal direction at about a 90 degree angle relative to the first rail. The feet and the rails can include cooperatively engageable locating elements for connection and engagement thereof in desired relation.

Importantly, each of the rails is locked into position on the respective foot to form a rigid assembly or structure, and so as to prevent looseness and accidental disengagement, sagging, and possible collapse of the bed frame as a result. According to a preferred embodiment, at least one locking element is provided for lockingly holding one of the rails in its respective receptacle or slot, in a position so as to bear against or retain or lock in the other of the rails, such that the rails associated with each foot are effectively interlocked together, providing sought after rigidity and strength. The receptacles or slots are also preferably positioned such that downward forces exerted by the box spring and mattress or other bedding, loads carried thereon, as well as some other anticipated additional loads, such as exerted by persons jumping onto the bed, will be directed, at least in some part, to hold the assembled members together.

DETAILED DESCRIPTION OF THE PREFERRED EMBODIMENTS

Figure 1:
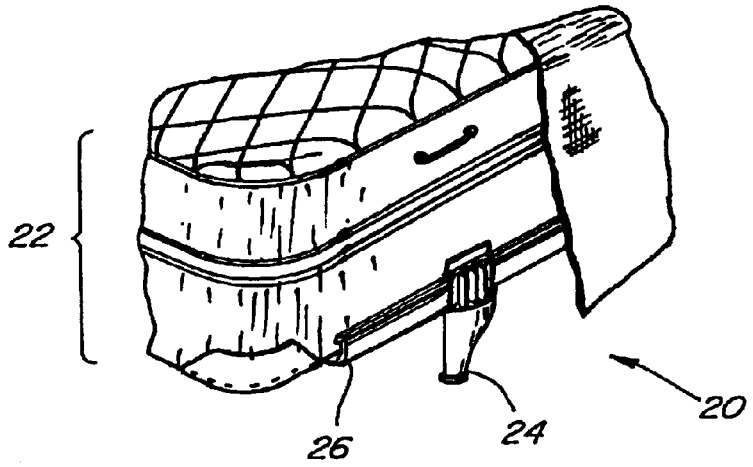
FIG. 1 is a fragmentary perspective view of a bed frame according to the present invention, and in particular, a foot and side rail of the frame, in supporting relation to a typical conventional box spring and mattress set.
Figure 2:
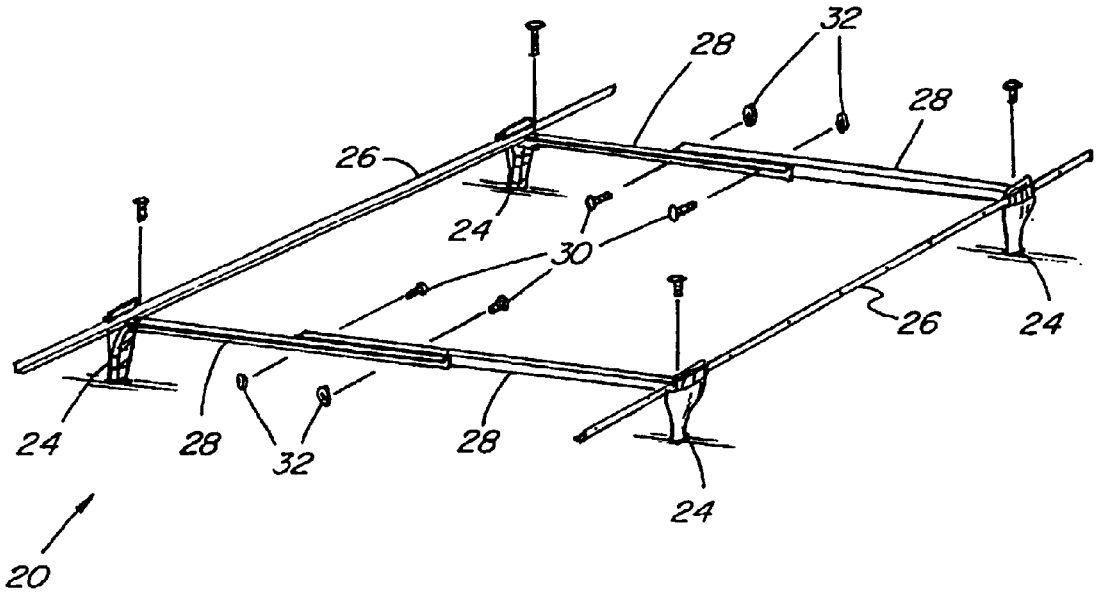
FIG. 2 is a perspective view of the frame being assembled.

Referring now to the drawings, FIG. 1 shows aspects of a bed frame 20 constructed and operable according to the teachings of the present invention, supporting a conventional box spring and mattress set 22 in a generally horizontal, flat orientation, one atop the other, in the well known manner. Referring also to FIG. 2, bed frame 20 generally includes a plurality of feet 24, a pair of side rails 26, and two pairs of cross rails 28, that can be assembled to form a rectangular platform, such as shown, and as defined by feet 24 at the corners of the rectangle which connect side rails 26 with cross rails 28 along the sides of the rectangle, respectively. Each pair of cross rails 28 preferably can be assembled so as to have a length corresponding to the width of a particular box spring and mattress set 22, by suitable fasteners, connectors or pins, as represented by bolts 30 which are inserted through selected ones of holes at various locations through rails 28, and are secured in position by nuts 32. Alternatively, a single cross rail 28 can be used at each end of bed frame 20 if for use with only one width of bed.

Figure 4:
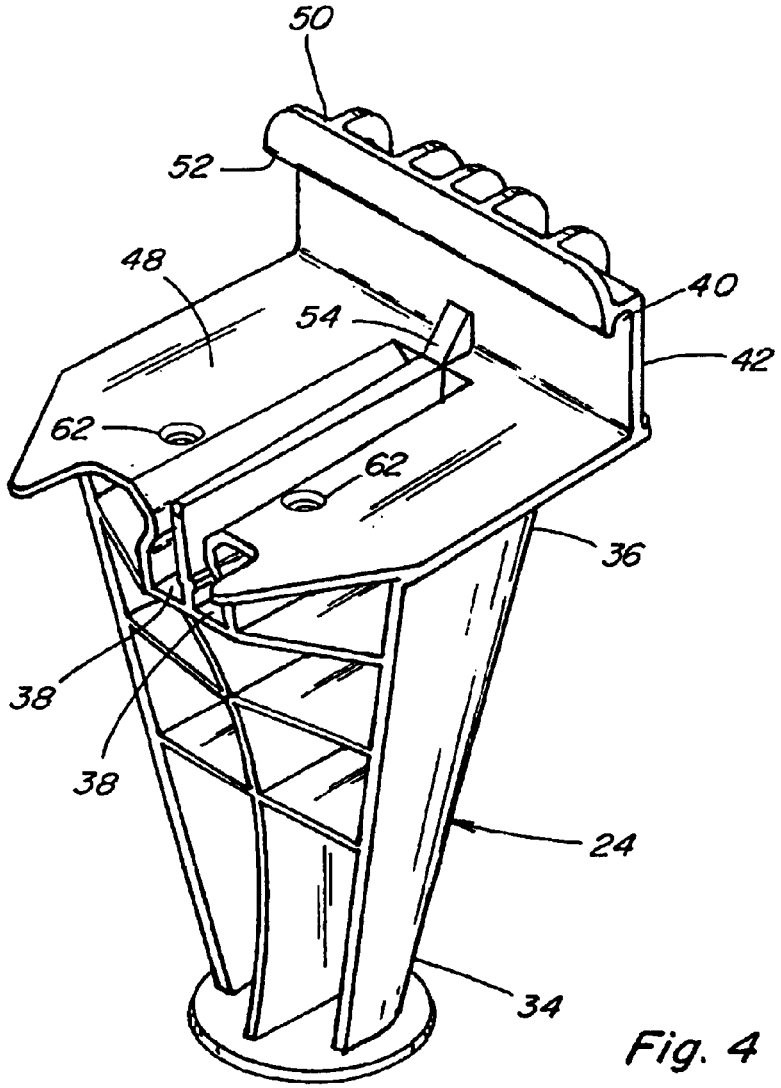
FIG. 4 is a perspective view of the foot of FIG. 1.
Figure 3:
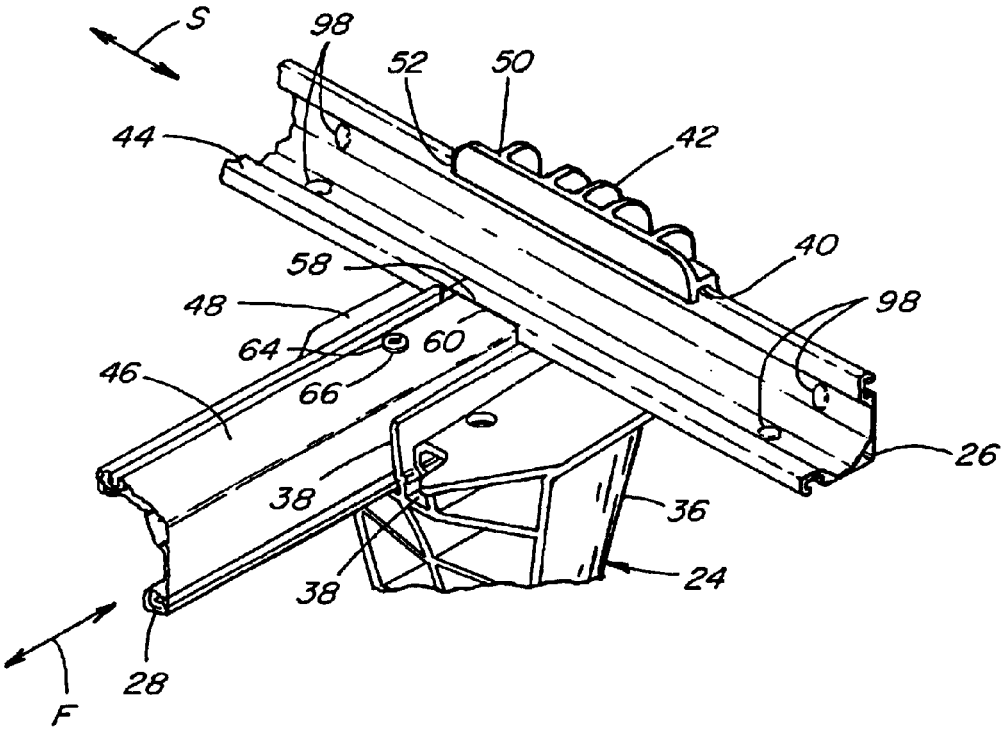
FIG. 3 is a fragmentary perspective view of another corner of the bed frame.

Bed frame 20 can be easily and quickly assembled. All of the feet 24 are interchangeable, as are side rails 26 and cross rails 28, respectively. Referring also to FIGS. 3 and 4, each foot 24 is preferably injection molded from a strong and rigid plastics material, such as, but not limited to, a glass filled plastics. Each foot 24 has a lower end 34 (FIG. 4) adapted to be positioned on a floor or other surface, and an opposite upper end 36, adapted to connect to and support rails 24 and 26 in about 90 degree angular relation one to the other in a generally horizontal plane. For this, upper end 36 of each foot 24 includes at least one first receptacle 38, which is preferably a slot open in a first horizontal direction, denoted as F in FIG. 3, and also upwardly, adapted for cooperatively receiving and holding one end of a cross rail 28 so as to extend from foot 24 in direction F. Each foot 24 additionally includes a second receptacle 40, which is preferably a passage formed by an upwardly extending retaining clip 42, adapted for cooperatively receiving and holding one of side rails 26 so as to extend from foot 24 in a second horizontal direction, denoted as S in FIG. 3, at the 90 degree angle to direction F set forth above. It is desired that rails 26 and 28 form a substantially flat, horizontal platform for supporting box spring and mattress set 22. To accomplish this, first and second receptacles 38 and 40 are positioned such that rails 26 and 28 have upwardly facing, substantially coplanar surfaces 44 and 46 (FIG. 3) which extend at least substantially around the rectangle formed by frame 20 and are suitably positioned for supportingly contacting the bottom of the box spring of set 22. To facilitate this, upper end 36 of each foot 24 preferably includes a substantially horizontal, upwardly facing surface 48 on which surfaces of both side rails 26 and cross rails 28 beneath surfaces 44 and 46 are located and supported when the rails are received in receptacles 38 and 40, respectively. Further, the portions of rails 26 and 28 supported on surface 48 are of the same vertical extent, such that, as a result, surfaces 44 and 46 will be located the same distance above surface 48 and thus substantially coplanar.

Figure 3A:
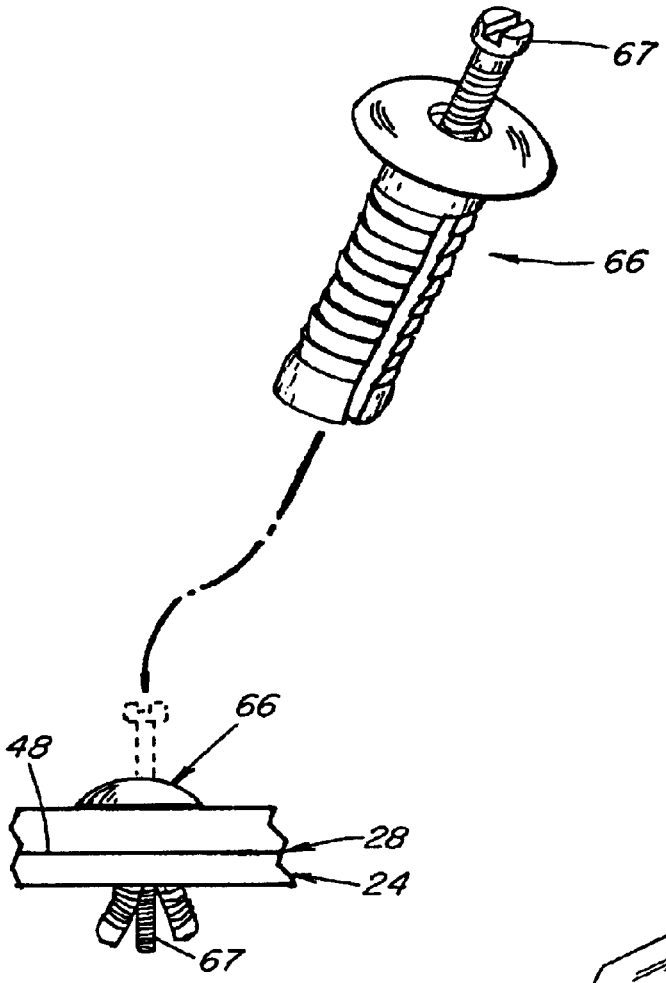
FIG. 3A is a fragmentary view of the corner of the bed frame showing a locking element usable therewith.

It is important for bed frame 20 to have substantial rigidity. It is also important that the bed frame be easy and quick to assemble. This is achieved using essentially three mechanisms: by rigidly holding rails 26 and 28 in engagement with feet 24; by interlocking the rails 26, 28 and feet 24 together; and by the inherent stiffness and resistance to bending and twisting of rails 26 and 28. In the former regard, receptacles 40 formed by retaining clips 42 of feet 24 each have a vertical extent from surface 48 which is substantially equal to or marginally smaller than a vertical extent of the portions of rails 26 received therein, and each clip 42 has an upper end 50 including a downwardly extending tab 52 spaced outwardly therefrom, forming essentially an inverted J shape, so as to hold each rail 26 tightly against sideward and upward and downward movement. Additionally, upper end 36 of each foot 24 additionally includes a locating element 54 at the intersection of clip 42 and surface 48 which protrudes into receptacle 40 and is cooperatively received in a correspondingly sized notch 56 (FIG. 8) stamped or cut in each side rail 26 at a predetermined location along the length thereof, for locating feet 24 at the desired locations along side rails 26 and for preventing relative longitudinal movement between rails 26 and feet 24, in direction S. As a result of the tight fit of rails 26 in receptacles 40 and prevention of relative longitudinal movement therebetween, rails 26 must be inserted into receptacles 40 by positioning the upper edge of the rail in the space between tab 52 and clip 42, and relatively rotating the rail and the foot such that the leg is brought, preferably by a light, hand force, into the lower portion of receptacle 40 such that locating element 54 is received in notch 56. Foot 24 and rail 26 are now locked together against relative longitudinal movement. Then, an end 58 of a rail 28 is inserted into receptacle 38 of the foot 24 so as to be brought into abutting relation with a correspondingly located edge portion 60 of the rail 26. Each foot 24 includes a hole 62 in surface 48 in predetermined relation to each receptacle 38, and each cross rail 28 includes a correspondingly located hole 64 therethrough, for receiving a locking element 66 therein, such as a known commercially available expanding drive pin or rivet which expands transversely when driven longitudinally, or a suitable threaded screw or other conventional fastener, to lock the rail 28 in the receptacle 38. Other members such as clips, clamps and the like, can also be used. Referring to FIG. 3A, an exemplary locking element 66 is illustrated in position for insertion into the holes through rail 28 and foot 24, with a drive screw 67 extending outwardly from one end of element 66, and also in position extending through rail 28 and surface 48 of foot 24 with drive screw 67 driven therethrough so as to extend from an opposite end thereof, such that element 66 is expanded and tightly holds rail 28 in receptacle 38 to prevent relative movement between rail 28 and foot 24 in direction F. Element 66 can be removed when desired by unscrewing drive screw 67 and reused several times if care is taken. Each side rail 26 has a predetermined transverse extent or width as measured from retaining clip 42 to edge portion 60, and holes 62 and 64 are positioned in predetermined relation to end 58 of cross rails 28, to position end 58 and edge portion 60 in the in the abutting relation when locking element 66 is installed. In this way, end 58 of each cross rail 28 is received and locked in position in a receptacle 38 of one of the feet 24 by a locking element 66, end 58, in turn, holding and locking the associated side rail 26 in receptacle 40, such that feet 24 and rails 26 and 28 are essentially interlocked securely and rigidly or substantially immovably together. Additionally in this respect, it is believed that loads applied in the vertical direction will add to or reinforce the locking force. When the corresponding cross rails 28 are aligned and positioned for a bed of a specific width, and bolted together, the rectangular bed frame as depicted in FIG. 2 is complete.

Here, referring more particularly to FIG. 4, it should be noted that each foot 24 includes two receptacles 38 which are parallel, mirror images of one another. This is desirable, as it allows any of the feet 24 to be used at any of the positions around bed frame 20, and for cross rails 28 that are connected to also be in parallel, side by side, mirror image relation one to the other for ease of fastening together. That is, two opposing feet 24 would receive the cross rails 28 to be connected together therebetween in offset opposing receptacles 38. On the other hand, if only a single cross rail 28 is to extend between the two opposing feet 24, directly opposing receptacles 38 could be used. Further, each receptacle 38 preferably has a cross sectional shape or profile when viewed in the direction F, which corresponds to the cross sectional shape or profile of the portion or leg of the cross rail 28 received therein, for more strongly and tightly holding it against relative movement in the direction F, as will be explained.

Figure 5:
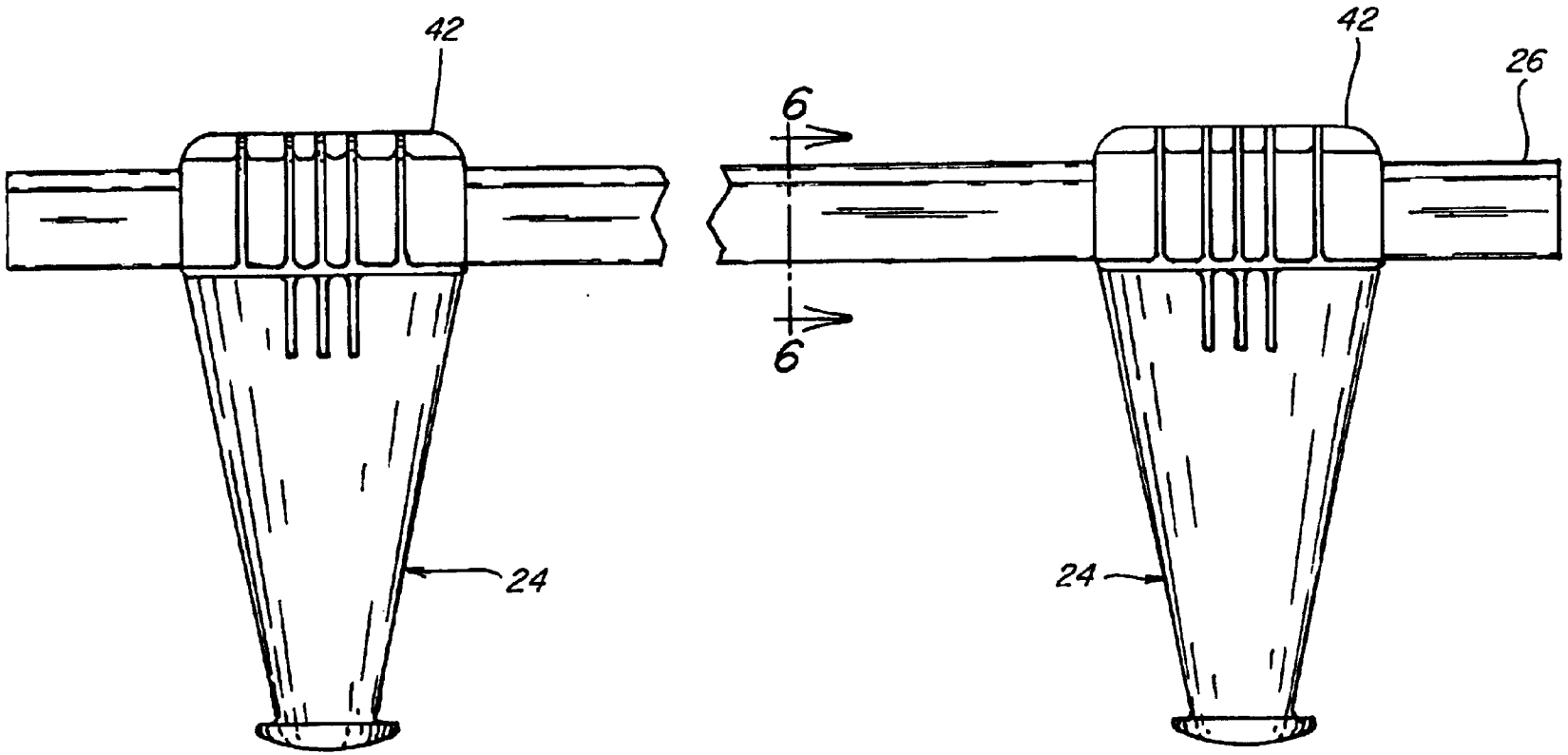
FIG. 5 is a side view of the frame of FIG. 1.

Referring also to FIG. 5, it should be noted that retaining clips 42 of feet 24 are preferably relatively long in the longitudinal direction along side rails 26, so as to provide adequate engagement to enhance strength and rigidity of bed frame 20.

Figure 6:
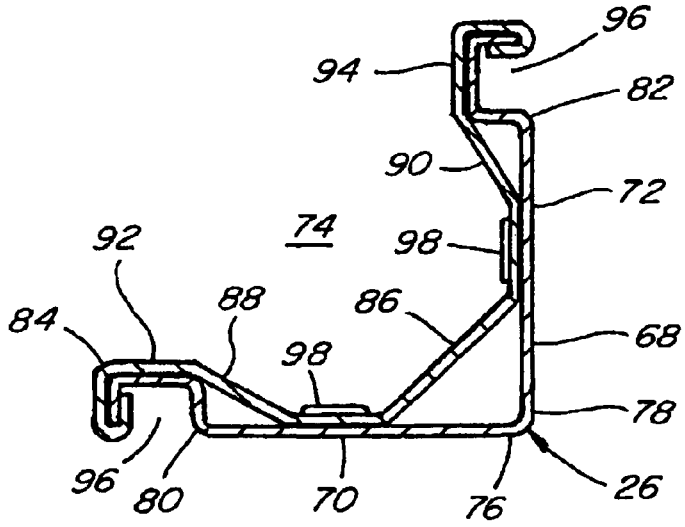
FIG. 6 is a sectional view of a rail of the frame, taken along line 6—6 of FIG. 5.

Referring to FIG. 6, a sectional view of one preferred side rail 26 is shown, which is also representative of a preferred cross rail 28. Preferred rail 26 is of roll-form steel construction, including elongate sheet metal elements or layers having a generally A shape profile when viewed from a longitudinal end thereof, including an outer sheet metal layer 68 which forms angularly related outer legs 70 and 72 of the A shape profile defining a space 74 therebetween, the outer legs 70 and 72 being connected together at proximal ends 76 and 78 thereof and having opposed distal ends 80 and 82. Rail 26 includes an inner sheet metal layer 84 disposed in space 74 between outer legs 70 and 72 and including a center brace portion 86 which spans space 74 at a location intermediate proximal ends 76 and 80 and distal ends 78 and 82 of respective outer legs 70 and 72, forming a triangular enclosure or beam section between brace portion 86 and the proximal ends. Brace portion 86 importantly stiffens the rail 26 or 38, particularly to prevent twisting under torsional loading. Inner sheet metal layer 84 further includes a pair of inner leg portions 88 and 90 extending from brace portion 86 to distal ends 80 and 82 of outer legs 70 and 72 in overlaying surface-to-surface contact therewith, respectively, for supporting and stiffening the legs. Inner leg portions 88 and 90 include distal end portions 92 and 94 folded and rigidly locked together with distal ends 80 and 82 of outer legs 70 and 72, respectively, to form a strong beam at the opposite ends of the legs extending the length of the rail for further strengthening and stiffening it, particularly against bending. Here, the distal ends form a generally U shape beam defining an outwardly facing channel 96, although it should be recognized that other manners of locking together to form a strengthening and stiffening beam can likewise be used, such as, but not limited to, by welding, waffling, crimping, and adhesives such as industrial cements such as epoxies.

Figure 6A:
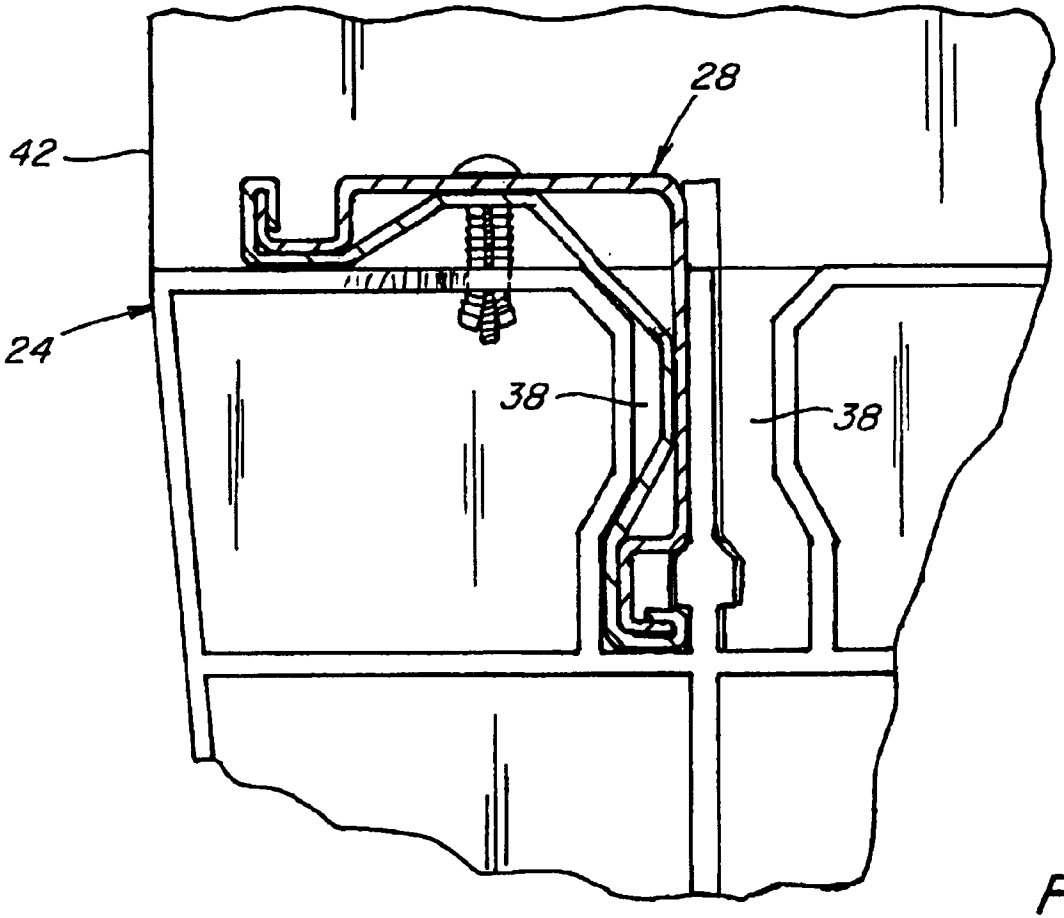
FIG. 6A is a side view of the foot and an end view of cross rail of FIG. 3.

Referring also to FIG. 6A, which is a side view of a foot 24 with a cross rail 28 installed in one of the receptacles 38 thereof, it can be seen that each receptacle 38 has a profile or sectional shape when viewed from the side, in the direction F (FIG. 3), which conforms largely to the profile or sectional shape of the portion of rail 28 located therein, or at least sufficiently such that insertion of rail 28 into receptacle 38 from the direction F is required, but also provides the advantage of more immovably and rigidly holding rail 28, particularly against relative movement in the upward and downward directions, and against relative rotation of foot 24 and rail 28 about an axis extending in direction F. One or both sides of receptacle 38 can also taper toward the other in the direction toward retaining clip 42, as shown, to increase the tightness and security of the fit.

Referring again to FIGS. 3 and 6, as another strengthening and stiffening feature, locking elements 98 are preferably provided at spaced intervals longitudinally along rails 26 for locking outer legs 70 and 72 and inner leg portions 88 and 90 together. Locking elements 98 can include, for instance, spaced connections available under the trade name Tog-L-Loc, which are formed in rails 26 and 28 by apparatus available from BTM Corporation of Maryland. This type of connection is preferred as it has the advantage of being made as part of or just after the process for manufacturing rails 26 and 28. Generally, a Tog-L-Loc locking element consists of a cup shape receptacle formed in one of the overlaying sheet metal layers which lockingly receives with an interference fit a correspondingly shaped element on the other of the layers. Other connections, such as, but not limited to, spot or continuous welds, rivets and other fasteners, adhesives, and lanced fingers could alternatively be used. It has been found that the combination of the shaping of inner sheet metal layer 84 to include center brace portion 86 so as to span space 74 intermediate proximal ends 76 and 78 and distal ends 80 and 82 of legs 70 and 72 of outer sheet metal layer 68, interlocking of distal ends 80 and 82 with distal end portions 92 and 94, and locking elements 98, can provide a strength and torsional stiffness sufficient for resisting significant bending and/or torsional loads typically exerted against a bed frame such as a frame 20, even when a person jumps on or onto the bed.

Figure 7:
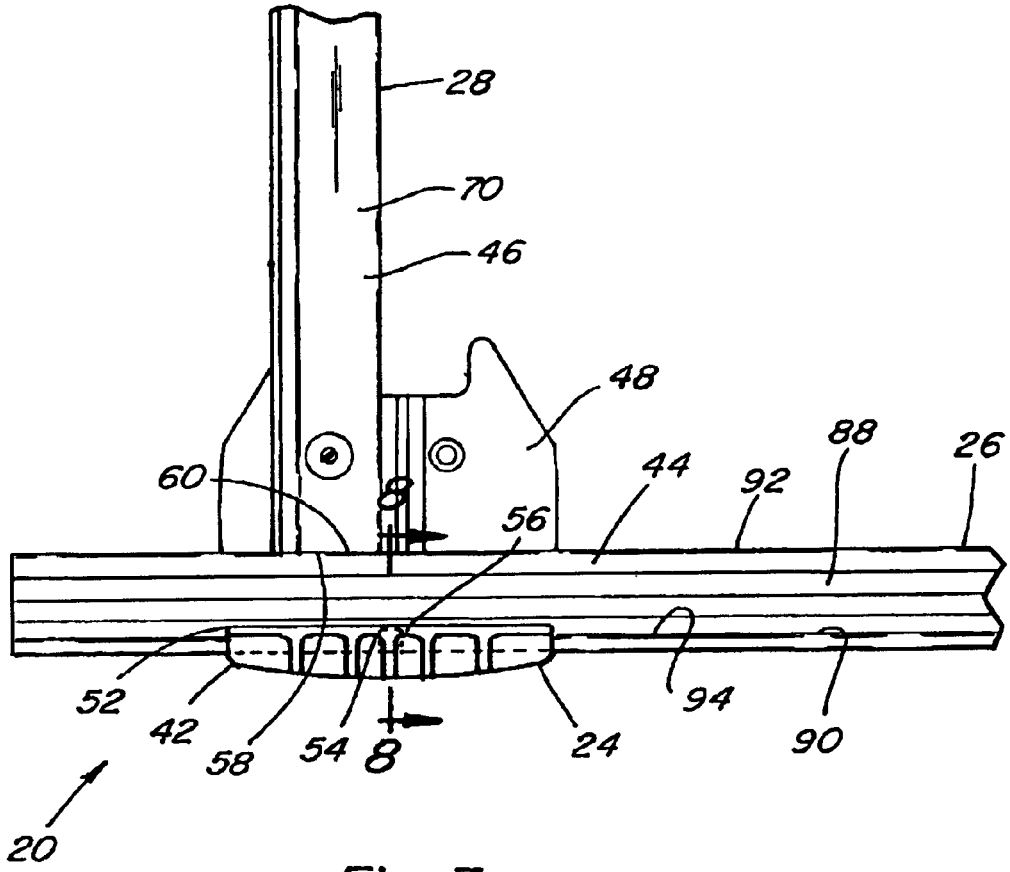
FIG. 7 is a fragmentary top view of a corner of the frame.
Figure 8:
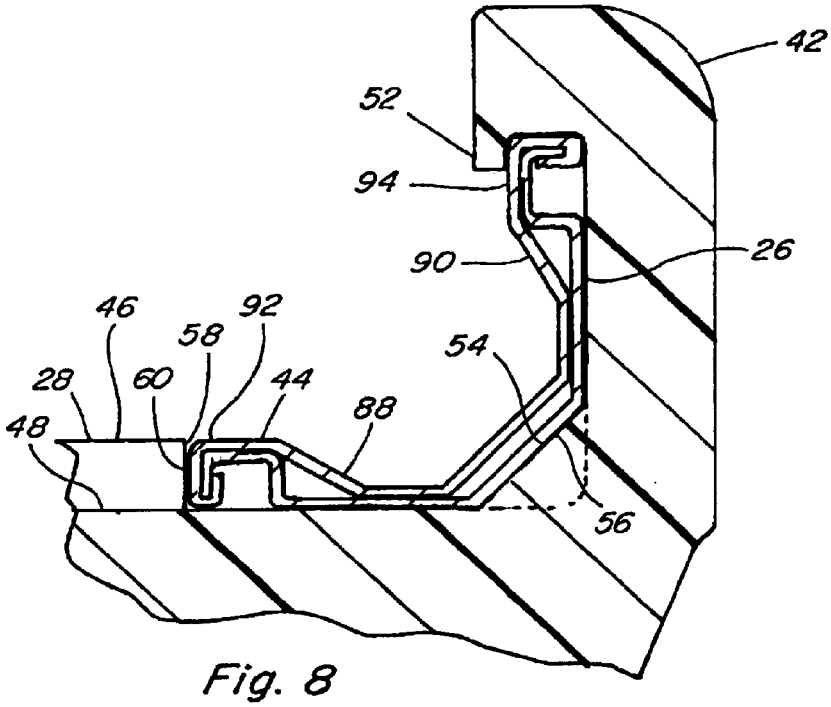
FIG. 8 is a fragmentary sectional view of the corner taken along line 8—8 of FIG. 7.

FIG. 7 is a top view of another corner of bed frame 20, and FIG. 8 is a sectional view through the corner, showing foot 24 and the abutting relation of end 58 and edge portion 60 of rails 26 and 28, and locating element 54 of foot 24 received in notch 56 of rail 26. Also shown is the location of upwardly facing surface 44 of rail 26 on distal end portion 92 of inner leg portion 88, which is substantially coplanar with surface 46 which is on a leg 70 of outer layer 68 of rail 28, both of which surfaces 44 and 46 are located a predetermined distance above upwardly facing surface 48 of foot 24. Also shown is close contact and engagement between tab 52 of retaining clip 42 and distal end portion 94 of inner leg portion 90 of rail 26, for holding rail 26.

Figure 9:
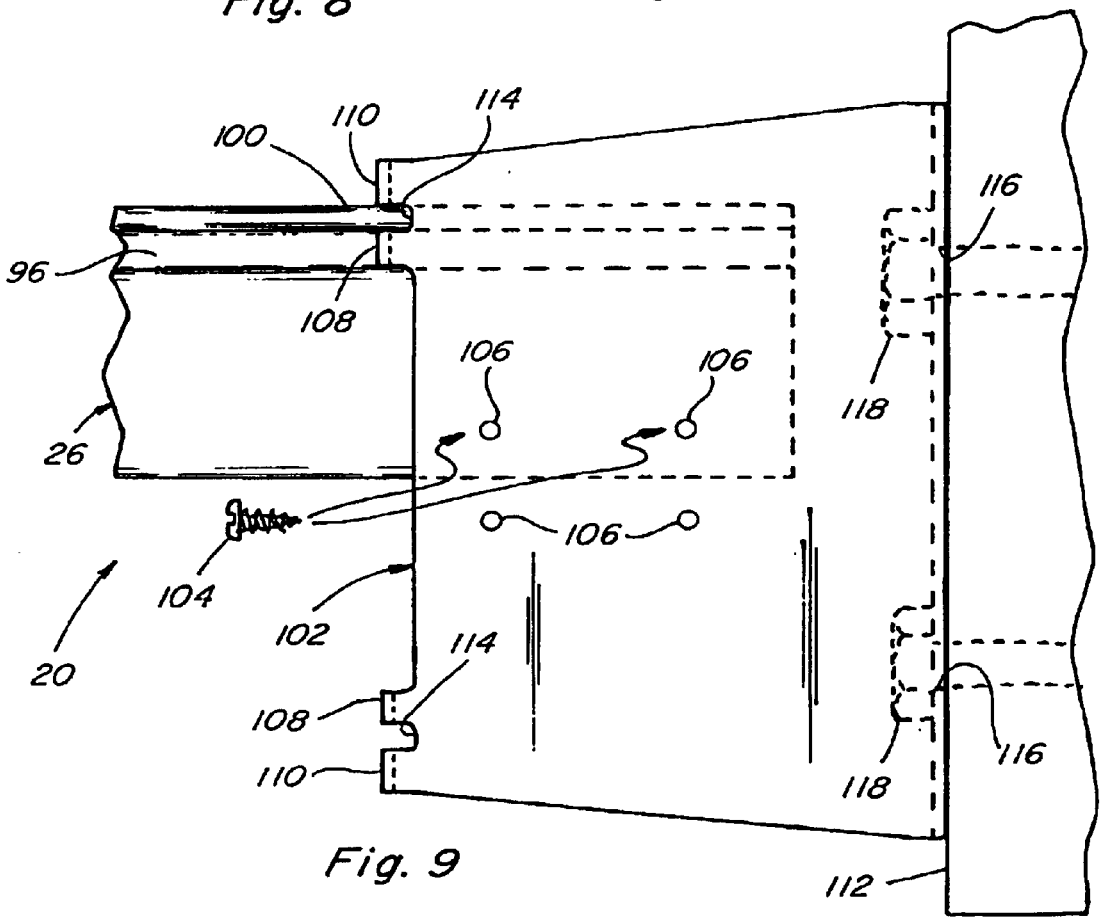
FIG. 9 is a fragmentary side view of the frame showing attachment of a head board or foot board thereto.

FIG. 9 is a side view of one end 100 of a side rail 26 showing connection of an optional bracket 102 thereto by a pair of screws 104 threadedly receivable in a pair of holes 106 through bracket 102 and rail 26 for connecting a head board or foot board 112 to bed frame 20. Bracket 102 includes a pair of ears 108 and 110 defining a notch 114 therebetween, the lower ear 108 being positionable in channel 96 of a leg of the rail 26 with the distal end portion 92 or 94 of the leg being received in notch 114 for locating bracket 102 in desired position on the rail. Bracket 102 has an L shape and includes holes 116 through the angled portion thereof for receiving fasteners 118 such as bolts or lag screws for securely fastening to the head board or foot board 112. Bracket 102 is a universal element usable at the end of any of the rails 26 and 28, as it include a second pair of ears 108 and 110 defining a notch 114 therebetween, the lower ear 108 (when bracket 102 is rotated 180 degrees about one or two axes) being positionable in channel 96 of a leg of the rail 26 with the distal end portion 92 or 94 of the leg being received in notch 114 for locating bracket 102 in desired position on the rail, as above.

Figure 10:
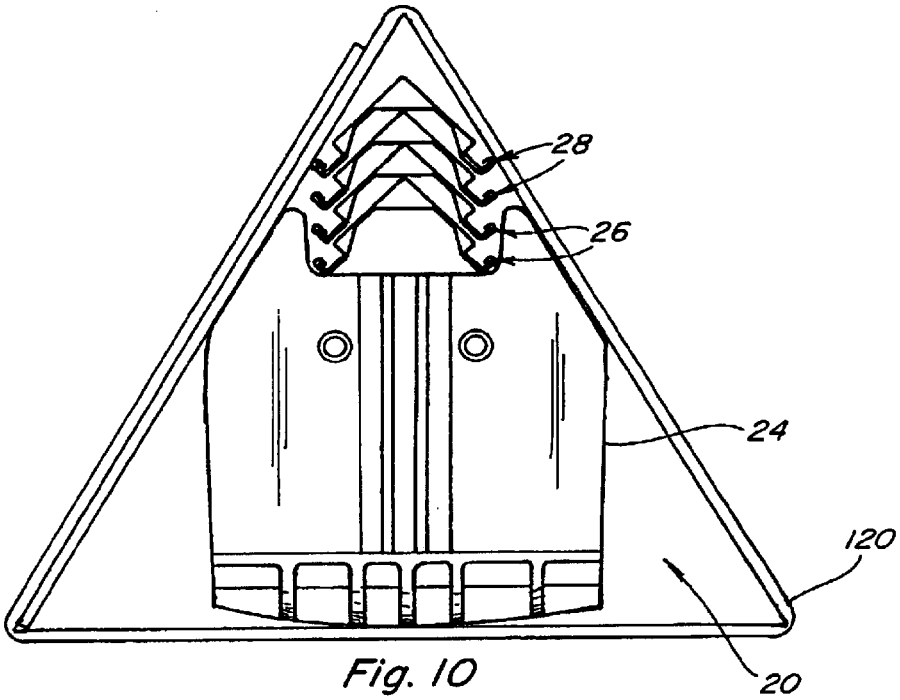
FIG. 10 is an end view of the frame disassembled and located in a packing box.

FIG. 10 is an end view of bed frame 20 shown with rails 26 and 28 stacked in a nesting relation one atop the other in position on feet 24, which are arranged in single a file one behind the other, to illustrate options for compact storage and transportation. Here, frame 20 is shown contained in a triangular container, which can be, for instance, of folded corrugated cardboard, sheet plastics, or the like, it being recognized that this illustrates just one of many arrangements and packaging options for bed frame 20.

Figure 11:
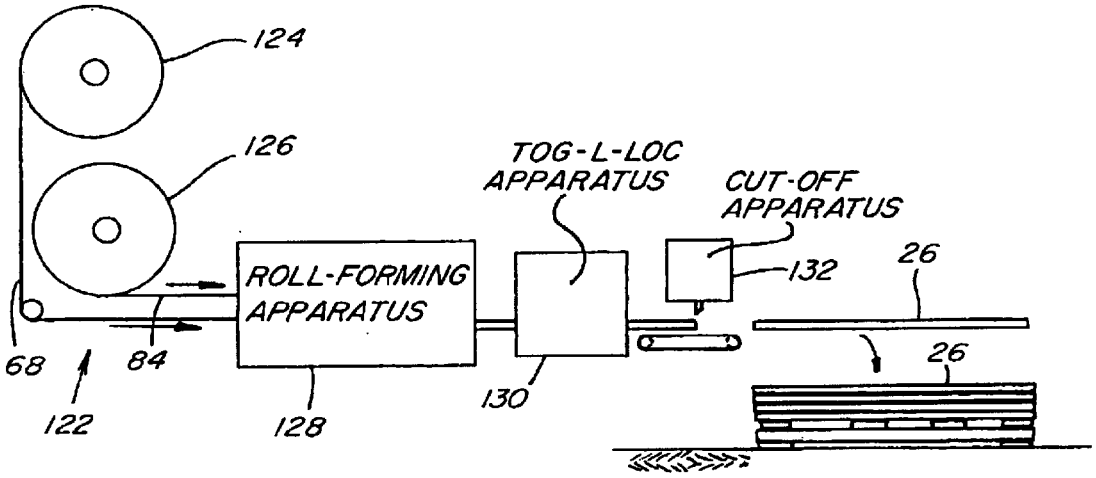
FIG. 11 is a simplified diagrammatic representation of a method of manufacturing the rails of the frame.

In FIG. 11, a simplified schematic diagram illustrating one method of roll-form manufacture of rails 26 and 28 is shown. In this method, rails 26 and 28 are continuously formed from two sheets 68 and 88 of suitable gauge steel, such as, but not limited to, a standard 16 gauge cold rolled steel, which can be optionally pre-painted, from coils 124 and 126, sheets 68 and 84 being fed into roll-forming apparatus 128, which can be, for instance, a roll-forming machine such as available from Custom Rollform Products, Inc. of St. Louis Mo. USA. Sheets 68 and 88 can be optionally pre-painted or coated for appearance and/or protection, if desired. Apparatus 128 can be custom built or configured to roll-form the sheets into the desired cross sectional shape, such as the A shape shown and discussed above, in the conventional well known manner. An optional conventional Tog-L-Loc apparatus 130 can be used to produce the Tog-L-Loc connections between the roll-formed layers 68 and 88. The holes in rails 26 and 28, such as holes 106 adjacent the ends of rails 26, can be die stamped by apparatus 128 or drilled or stamped by a subsequent machine (not shown). Rails 26 and 28 are cut to the desired or required length, by a suitable machine such as a conventional cut-off apparatus 132. The rails can then be packaged with the other items to complete a bed frame 20 kit, such as depicted in FIG. 10.

Figure 12:
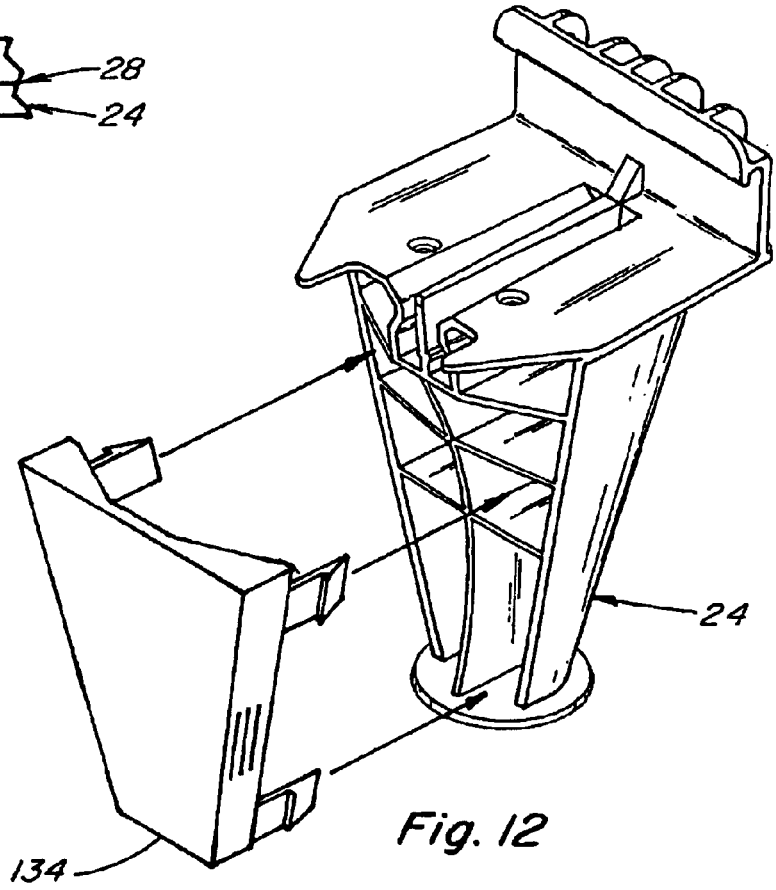
FIG. 12 is another perspective view of the foot of FIG. 1, showing an optional cover for concealing articles in cavities in the foot.

Referring to FIG. 12, foot 24 is shown in association with an optional cover 134 including outwardly extending barbed tabs or other elements for removably cooperatively engaging or snapping to the foot as illustrated by the arrows for covering and concealing a hollow cavity or cavities in the foot, which can be useful for hiding small articles such as valuables such as jewelry, keys, and the like.

Figure 13:
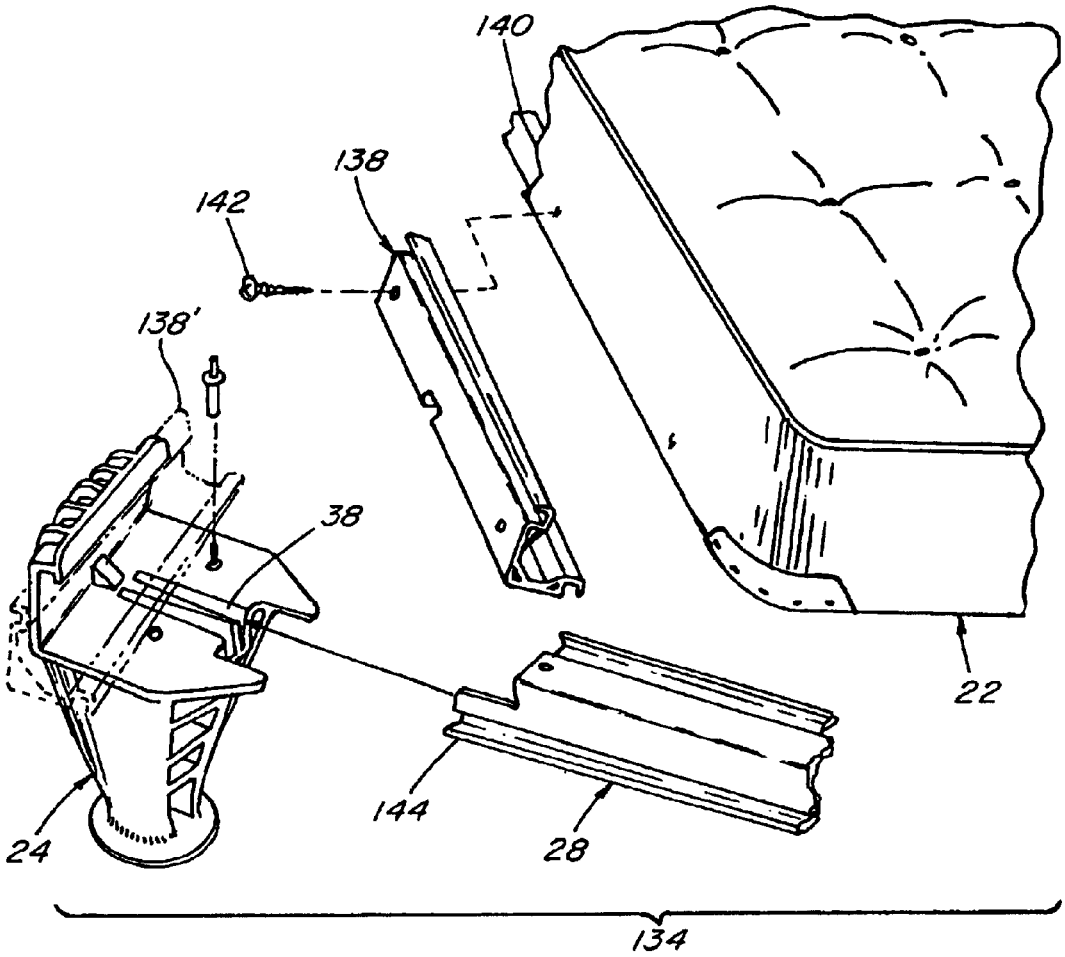
FIG. 13 is a fragmentary perspective view of aspects of an alternative bed frame according to the invention.

In FIG. 13, representative aspects of an alternative bed frame 136 embodying the teachings of the present invention is shown, like parts of bed frame 136 and bed frame 20 being identified by like numbers. Here, one foot 24 of four feet is shown, along with one cross rail 28 of two. Bed frame 136 differs from frame 20 in the provision of four stub side rails 138, only one of which is illustrated, and each of which is fastenable to a lower side edge support element 140 of the box spring of box spring and mattress set 22, using suitable fasteners such as one or more screws 142 as illustrated. Each stub side rail 138 is preferably similar in construction to side rails 26 as set forth above, but is preferably substantially shorter, for example, as short as about 6 inches in length or so, or sufficient in length so as to support a corner of a bed with which frame 136 is used and anticipated loads carried thereon. Each stub side rail 138 is cooperatively receivable and engageable with one of the feet 24 in the above described manner, as illustrated in dotted lines at 138'.

Figure 14:
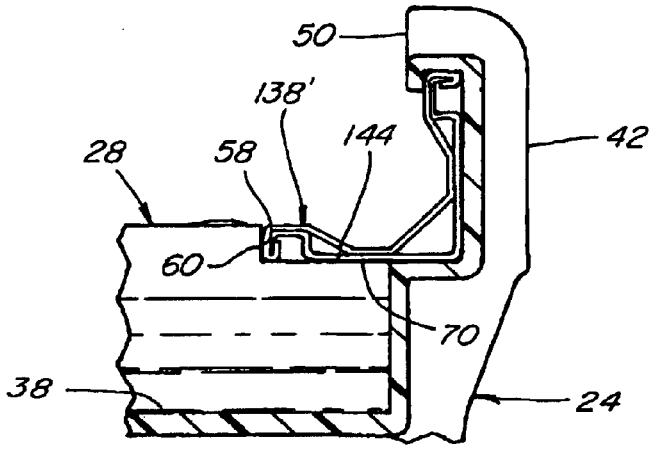
FIG. 14 is a sectional view illustrating locking together of a side rail and a cross rail of the bed frame of FIG. 13.

Referring also to FIG. 14, each of the cross rails 28 is preferably the same as cross rails 28 described above, and differs therefrom only in the provision of an optional notched end 144 which will extend deeper into slot 38 of foot 24 and beneath stub side rail 138', such that end 144 will abut the lowers surface of leg 70 rail 138', and end 58 will be located longitudinally inwardly and will still abut edge portion 60 of rail 138', to provide greater rigidity or stiffness when certain dynamic loading conditions are applied against the joint. For instance, when a load is applied to cross rail 28 in such a manner as to urge the notched end 144 upwardly against surface 70, rail 138', in turn, will be urged upwardly against upper end 50 of retaining clip 42, and longitudinal acting forces of end 58 against edge portion 60 will act to urge rail 138' against retaining clip 42. Additionally, forces exerted against foot 24 to rotate it in a counterclockwise direction would act to urge surface 70 of rail 138' downwardly against notched end 144. Notched end 144 can also be used on side rails 28 of bed frame 20 to provide the same structural benefit.

Here, it should also be recognized and understood that bed frames and elements thereof according to the present invention can be configured differently from the embodiments disclosed above. For instance, it is anticipated that feet 24 could be used with conventional L shape solid steel angle bed rails, and with other roll-form bed rail configurations having the requisite strength, stiffness, and other properties. The feet can also be configured differently, including, for instance other receptacles or structures for holding the rails in the desired orientation and position, and one or more additional feet can be utilized at different locations, such as, for instance, for connecting together the cross rails and/or for providing additional support for the frame at locations along the side rails and/or cross rails, as desired. The rails, particularly the cross rails can also be configured or arranged differently, for instance, such that the cross rails form an X shape or the like.

Thus, there has been shown and described a novel bed frame, including rails and feet therefor which are easy to assemble into a strong, rigid structure for supporting bedding such as a box spring and mattress set, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A bed frame assembly, comprising:

a plurality of elongate rails, each of the rails having about a 90 degree angular cross-sectional shape when viewed longitudinally defined by a pair of legs connected at proximal ends thereof, each of the legs having a distal end opposite the proximal end thereof, and each of the rails having a predetermined transverse extent along at least one of the legs thereof;

a plurality of feet, each of the feet including a lower portion and an upper locking portion, each of the feet being adapted to be positioned in an upstanding orientation on the lower portion with the upper locking portion thereabove, the upper locking portion including a horizontal surface having at least one slot therein extending in a first predetermined horizontal direction and adapted for receiving a longitudinal end of one of the legs of a first of the rails with an end of the other of the legs of the first rail located on the horizontal surface such that the first rail extends in the first horizontal direction from the foot, and a retaining clip extending upwardly from the horizontal surface and defining a passage above the horizontal surface extending in a second horizontal direction at about a 90 degree angle relative to the first horizontal direction, the passage having a predetermined vertical extent about equal to or marginally smaller than the predetermined transverse extent for receiving one of the legs of a second of the rails with the other of the legs thereof located on the horizontal surface and the second rail oriented so as to extend in the second horizontal direction, the retaining clip including an element engageable with the one leg of the second rail for holding the second rail in a position relative to the slot such that the end of the first rail when received in the slot will be in abutting relation with the second rail; and at least one locking element engageable with the foot and at least one of the first or second rails, for lockingly holding the rails on the foot in the abutting relation.

2. The bed frame assembly of claim 1, wherein the at least one locking element comprises a pin cooperatively receivable and releasably lockable in a hole in the foot.

3. The bed frame assembly of claim 1, wherein the horizontal surface of at least two of the feet has a second one of the slots therein extending in the first predetermined horizontal direction.

4. The bed frame assembly of claim 1, wherein the element of the retaining clip engageable with the one leg of the second rail for holding the second rail in a position relative to the slot allows removal of the one leg of the second rail from the passage when the first rail is absent from the slot.

5. The bed frame assembly of claim 1, wherein at least one of the feet includes an internal compartment for receiving and holding articles therein.

6. The bed frame assembly of claim 1, wherein the 90 degree angular cross-sectional shape of each of the rails comprises a multiple layer sheet metal structure including an outer layer comprising outer surfaces of the pair of legs and an inner layer comprising inner surfaces thereof, the inner layer including a center brace portion that spans a space defined by the pair of legs and connects thereto, the inner and outer layers including interlocked distal portions comprising the distal ends of the pair of legs which form stiffening beams extending the length of the rail.

7. The bed frame assembly of claim 6, wherein the interlocked distal portions each have a U-shape which is open in a direction facing away from the inner layer.

8. The bed frame assembly of claim 6, wherein the center brace portion is oriented at about a 45 degree angle to the pair of legs.

9. The bed frame assembly of claim 1, wherein each of the rails is roll-formed.

10. The bed frame assembly of claim 1, wherein each of the feet and the second rail include elements cooperatively engageable for preventing longitudinal movement of the second rail relative to the foot when engaged by the retaining clip.

11. The bed frame assembly of claim 1, wherein each of the feet are injection molded of a glass filled plastics material.

12. A bed frame comprising:

a plurality of roll-form bed rails each including overlaying elongate outer and inner sheet metal layers, the outer sheet metal layer having an angular cross-sectional shape including unitary first and second outer legs connected together at proximal ends thereof and oriented one relative to the other at about a 90° angle defining a space therebetween, each of the outer legs having a distal end opposite the proximal end thereof, the inner sheet metal layer being disposed in the space between the outer legs of the outer sheet metal layer and having an angular cross-sectional shape including a center brace portion and first and second inner leg portions extending at about a 90° angle one relative to the other from the center brace portion, the inner leg portions overlaying the outer legs, respectively, in surface to surface contact therewith along the length thereof, and including distal end portions lockingly engaged with the distal ends of the outer legs, respectively, for preventing relative movement thereof and a plurality of feet, each of the feet including an upper end including a first receptacle and a second receptacle oriented at about a 90 degree angle to the first receptacle, the first receptacle being adapted for receiving one of the bed rails in a position extending horizontally outwardly from the foot, the second receptacle being adapted for receiving another of the bed rails in a position extending horizontally at about a 90 degree angle to said one of the rails, such that the bed rails form a substantially planar rectangular structure for supporting a box sprint, wherein the first receptacle includes at least one slot extending into a generally horizontal upwardly facing surface on the upper end of the foot adapted for receiving said one of the bed rails extending horizontally outwardly from the foot, the second receptacle comprises a retaining clip extending upwardly from the surface and oriented at about a 90° angle to the slot and configured for holding said another of the rails received in an upstanding orientation and preventing at least upward movement thereof, said one of the bed rails when received in the slot of the first receptacle being located in abutment with said another of the bed rails when received in the second receptacle, and at least one locking element for lockingly holding said one of the rails in the first receptacle for holding said another of the bed rails in the second receptacle.

13. The bed frame of claim 12, wherein the slot is positioned on the surface such that an end of a rail held therein will be positioned so as to hold a rail in position in the second receptacle.

14. The bed frame of claim 13, wherein the rail to be held in the slot has a notched end to be located in abutment with the rail positioned in the second receptacle.

15. The bed frame of claim 13, wherein the at least one locking element comprise a hole in the surface and a locking pin adapted to be removably received in the hole for holding the end of the rail in the slot.

16. The bed frame of claim 12, further comprising a second slot extending into the surface for receiving and holding one of the bed rails extending horizontally outwardly from the foot.

17. The bed frame of claim 12, wherein the retaining clip comprises an upper distal end including a tab defining a slot for receiving and holding a distal end of one of the legs of one of the rails.

18. The bed frame of claim 12, wherein at least one of the feet includes an internal compartment for receiving and holding articles therein.

19. The bed frame of claim 12, further comprising at least two brackets adapted for connecting a headboard or a foot board to ends of a pair of the rails, respectively, each of the brackets and each of the ends of the rails including elements cooperatively engageable for mounting the bracket in a predetermined location and orientation on the end of the rail for connection to the headboard of the foot board.

20. The bed frame of claim 12, wherein the feet are injection molded of a glass filled plastics material.

21. A bed frame assembly for supporting a bed in a substantially flat manner above a floor, comprising:

a plurality of elongate rails, each of the rails having an angular cross sectional shape defined by a pair of angularly related legs connected together at proximal ends thereof and extending divergingly to distal ends thereof, respectively;

a plurality of feet for connecting the rails together to form a rectangular and at least substantially planar support platform for supporting and holding the bed in the substantially flat manner, each of the feet including opposite lower and upper portions, and each of the feet being adapted to be positioned in an upstanding orientation on the lower portion thereof and connected to two of the rails for forming a corner of the rectangle, the upper portion of each of the feet defining at least one receptacle oriented in a first predetermined horizontal direction and adapted for receiving a longitudinal end of at least one of the legs of a first of the rails, and a second receptacle oriented in a second predetermined horizontal direction oriented at about a 90 degree angle to the first horizontal direction and adapted for receiving at least one of the legs of a second of the rails, such that when received in the receptacles, respectively, the first and second rails are in abutting relation and extend in horizontal directions oriented at about a 90 degree angle one relative to the other with surfaces of the rails in an upwardly facing substantially coplanar orientation defining the platform; and elements cooperatively engageable with each of the feet, respectively, for holding the rails in the abutting relation, wherein the at least one receptacle comprises a slot in the upper end which is open in the upward direction and in the first horizontal direction, the slot having a size and shape corresponding to an outer profile size and shape of the legs of said one of the rails, and the second receptacle is formed by structure extending upwardly from the upper end a distance corresponding to a sideward extent of said one of the less of the second rail and including a tab for cooperatively engaging and holding the distal end of said one of the lees and preventing upward movement thereof from the foot.

22. The bed frame assembly of claim 21, wherein the structure has an inverted J shape profile when viewed from the second horizontal direction.

23. The bed frame assembly of claim 21, wherein the structure is adapted for allowing inserting said one of the legs of the second rail into the second receptacle by rotating the second rail about an axis extending in the second horizontal direction, for cooperatively engaging the distal end of said one of the legs with the tab.

24. The bed frame assembly of claim 21, wherein the elements cooperatively engageable with each of the feet, respectively, for holding the rails in the abutting relation, comprise pins insertable through holes through the first rails and securable in holes in the upper end of each of the feet, respectively, for holding the first rail in position in abutment with the second rail.

25. The bed frame assembly of claim 21, wherein the upper portion of each of the feet includes two of the receptacles oriented in the first predetermined horizontal direction and adapted for receiving a longitudinal end of at least one of the legs of a first of the rails, the two receptacles having profile shapes when viewed from the first horizontal direction which are mirror images of each other, such that a leg of a rail can be received in the receptacles in different orientations when viewed from the first horizontal direction.

26. The bed frame assembly of claim 21, wherein the feet each comprise an injection molded member of a glass filled plastics material.

27. A bed frame comprising:

a plurality of elongate rails, each of the rails having about a 90 degree angular cross sectional shape when viewed from a longitudinal end of the rail defined by a pair of legs connected at proximal ends thereof, and each of the rails having a predetermined transverse extent along at least one of the legs thereof;

a plurality of feet, each of the feet having an upper end including a substantially horizontal surface including a first receptacle for receiving one of the rails so as to extend longitudinally from the foot in a first horizontal direction, and a second receptacle for receiving another of the rails so as to extend longitudinally from the foot in a second horizontal direction oriented at about a 90 degree angle to the first horizontal direction, wherein the first receptacle includes a slot in the horizontal surface adapted for receiving one of the legs of said one of the rails such that the other of the legs thereof rests on the horizontal surface, the second receptacle includes a retaining clip extending upwardly from the horizontal surface and adapted for receiving and holding one of the legs of said another of the rails such that the other of the legs thereof rests on the horizontal surface in substantially coplanar and abutting relation to said other of the legs of said one of the rails; and at least one locking element for lockingly holding said one of the rails in the first receptacle in abutment with said another of the rails in the second receptacle for holding said another of the rails in the second receptacle.

28. The bed frame of claim 27, wherein the at least one locking element comprises a pin cooperatively receivable in a hole extending through said one of the rails, and a hole in the horizontal surface of each of the feet.

29. The bed frame of claim 27, wherein the retaining clip includes an element cooperatively engageable with said one of the legs of said another of the rails for preventing movement of said one of the legs of said another of the rails in the first horizontal direction.

30. The bed frame of claim 27, wherein the cross-sectional shape of each of the rails comprises a multiple layer sheet metal structure including an outer layer comprising outer surfaces of the pair of legs and an inner layer comprising inner surfaces thereof, the inner layer including a center brace portion that spans a space defined by the pair of legs and connects thereto, the inner and outer layers including interlocked distal portions comprising the distal ends of the pair of legs which form stiffening beams extending the length of the rail.

31. The bed frame of claim 30, wherein the interlocked distal portions each have a U-shape which is open in a direction facing away from the inner layer.

32. The bed frame of claim 30, wherein the center brace portion is oriented at about a 45 degree angle to the pair of legs.

33. The bed frame of claim 30, wherein each of the rails is roll-formed.

* * * * *